US007544891B2

(12) United States Patent
Kuo

(10) Patent No.: US 7,544,891 B2
(45) Date of Patent: Jun. 9, 2009

(54) ADJUSTING MEMBER FOR CABLE

(75) Inventor: Peter Kuo, Tu-cheng (TW)

(73) Assignee: Hon Hai Precision Ind. Co., Ltd., Taipei (TW)

( * ) Notice: Subject to any disclaimer, the term of this patent is extended or adjusted under 35 U.S.C. 154(b) by 265 days.

(21) Appl. No.: 11/593,232

(22) Filed: Nov. 6, 2006

(65) Prior Publication Data

US 2007/0105403 A1 May 10, 2007

(30) Foreign Application Priority Data

Nov. 4, 2005 (CN) ..... 2005 2 0077188

(51) Int. Cl.
*H01R 4/00* (2006.01)

(52) U.S. Cl. ..... 174/84 R; 174/88 S; 381/370

(58) Field of Classification Search ..... 174/74 R, 174/75 D, 77 R, 79, 74 A, 84 R, 88 R, 88 S, 174/91; 381/370, 371, 374, 381, 384
See application file for complete search history.

(56) References Cited

U.S. PATENT DOCUMENTS 3,667,569 A * 6/1972 Mackey et al. ..... 181/135
6,483,925 B1 * 11/2002 Shen et al. ..... 381/370
6,909,050 B1 * 6/2005 Bradford ..... 174/110 R
6,945,663 B2 * 9/2005 Chien ..... 362/84
2005/0236769 A1 * 10/2005 Wei ..... 273/244
2007/0053523 A1 * 3/2007 Iuliis et al. ..... 381/77
2008/0159579 A1 * 7/2008 Park ..... 381/370

FOREIGN PATENT DOCUMENTS

CN 2169250 6/1994

* cited by examiner

*Primary Examiner*—William H Mayo, III
(74) *Attorney, Agent, or Firm*—Wei Te Chung

(57) ABSTRACT

An adjusting member (1) for cable (2) is separated into a first and a second half body (11, 12) each defining a cavity, respectively. The cavities defined on the first and second bodies are used to receive a cable (2). The cable includes an earphone cable and a signal cable, and the earphone cable has a free end. The adjusting member (1) can adjust the length of the free end of the earphone cable by sliding on the cable (2). And the adjusting member can stick on the cable via assembling the first and second half bodies together.

15 Claims, 7 Drawing Sheets

ADJUSTING MEMBER FOR CABLE

BACKGROUND OF THE INVENTION

1. Field of the Invention

The present invention relates to an adjusting member for cable, and particularly to an adjusting member for earphone cable.

2. Description of Prior Arts

Today, people need more information to communicate with each other frequently. So, many portable electronic equipments, such as the walkman, MP3, handset and other sound players, become an important part in people's life. Usually, an earphone is used on the music player or handset. Accordingly, there are many different kinds of earphone. One kind of earphone is circumaural earphone. The strip of the circumaural earphone bestrides the head and the earphone extrudes the ears of a user. However, the structure of the circumaural earphone makes the user feel uncomfortable and take it inconveniently.

And then, another type of earphone is popular with people, it is the insert type earphone. One end of the insert earphone is an earphone inserted into the ear of the user directly, and the other end of the insert type earphone is connected to the music player or handset by a plug. Then we can use the insert type earphone conveniently at any time, the insert earphone is light and convenient to take.

The conventional adjusting member for cable is a ball having a receiving channel. The earphone cable is received in the channel, and then the ball can slide along the cable to adjust the length of the earphone cable. The ball is fixed on the cable by the force friction between the cable and the inner surface of the channel. However, the structure of the ball is too simple to adjust the length of the cable, as the ball being slid up and down the friction-free between the cable and the inner surface of the channel will become less and less, then the force friction would be not enough to make the ball to adjust the length of the earphone cable.

Obviously, we need a new adjusting member for cable, which could adjust the cable stably and efficiently.

SUMMARY OF THE INVENTION

An object of the present invention is to provide an adjusting member to adjust the length of the earphone cable efficiently.

To achieve the above object, an adjusting member assembles to a cable, it defines at least one cavity to receive the cable, and the adjusting member can adjust the length of the earphone cable by sliding and fixing on the cable, it comprises: a first half body, defining a first cavity; and a second half body, defining a second cavity; wherein the first half body is assembled to the second half body thereby forming the adjusting member. The first cavity and the second cavity form together a cavity to receive the cable, which extend through the adjust member. The first cavity and the second cavity are defined eccentrically, when the first half body and the second half body are assembled.

An adjusting member assembles to a cable, it defines at least one cavity to receive the cable, and the adjusting member can adjust the length of the earphone cable by sliding and fixing on the cable, it comprises: a first half body made of soft material, defining a first cavity and a channel; a second half body made of hard material, defining a second cavity and a pin, and the dimension of the pin is larger than the channel; wherein the first half body is assembled to the second half body, the first cavity and the second cavity form a cavity to receive the cable, which extends through the adjust member. The pin is inserted into the channel to drive the inner side of channel to distort inwardly when the first and second half body are assembled.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
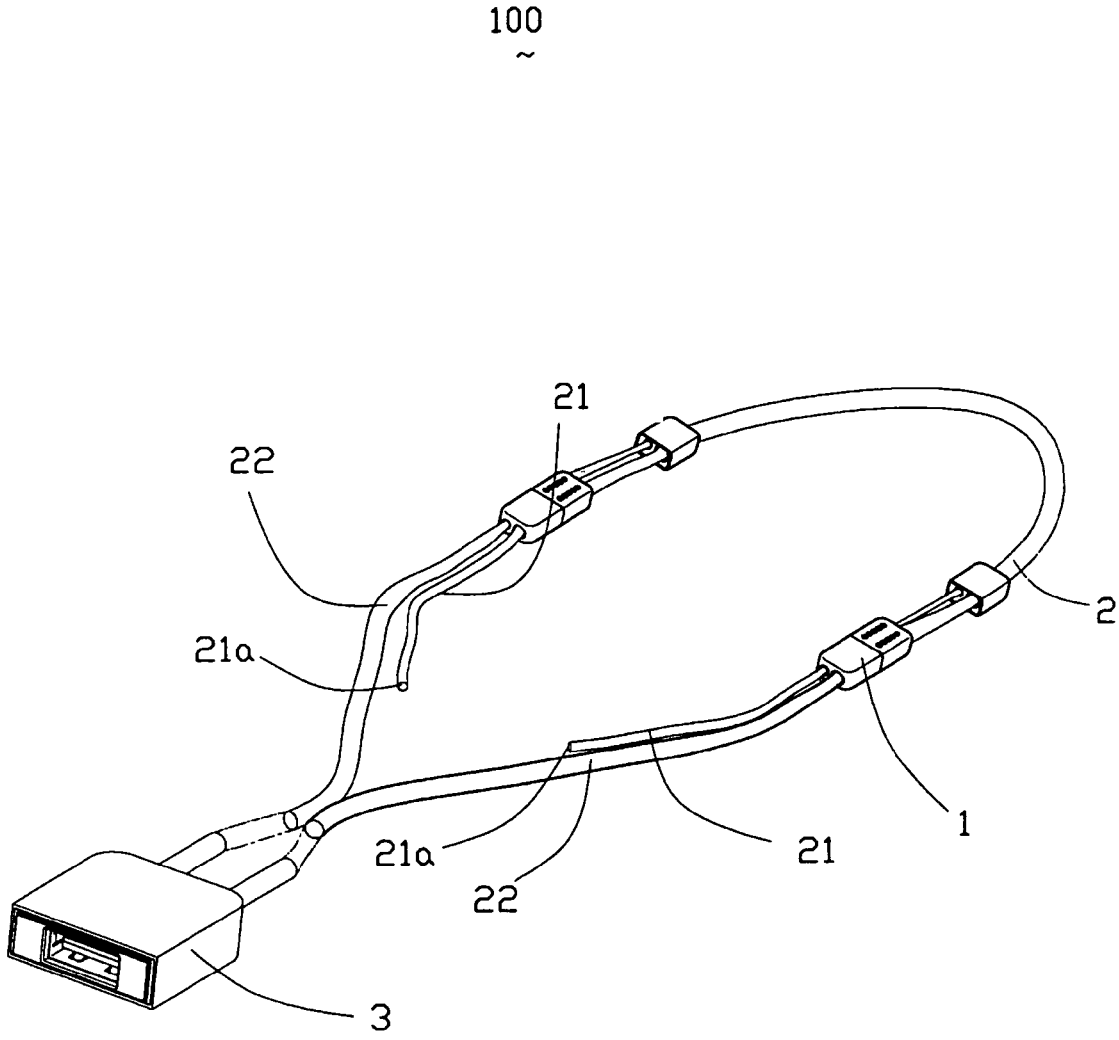
FIG. 1 is an assembled, perspective view of an adjusting member assembled to a cable in accordance with the present invention.
Figure 2:
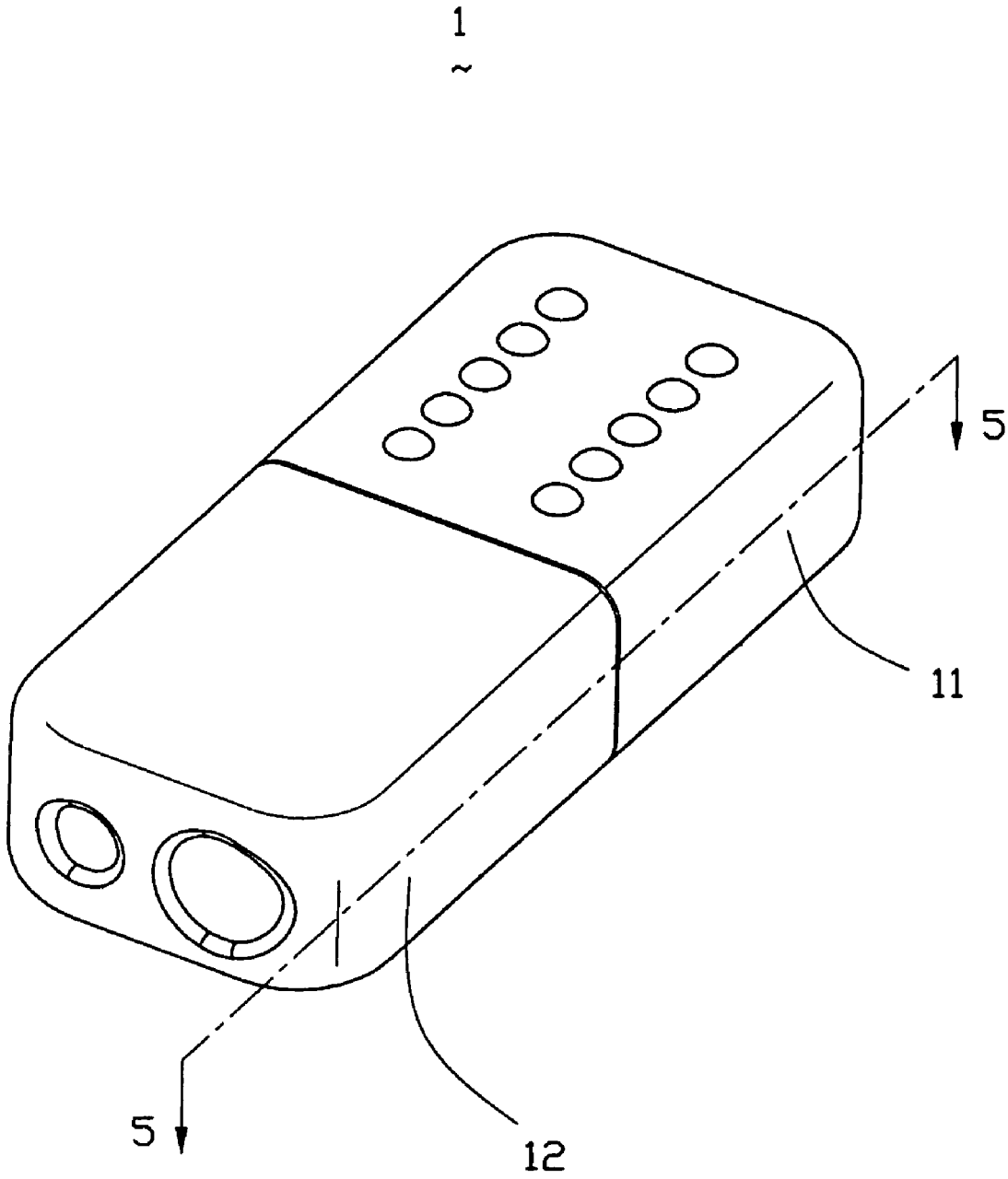
FIG. 2 is an assembled, perspective view of the adjusting member of FIG. 1.

Referring to FIGS. 1 and 2, the present invention relates to an adjusting member 1 for assembling to a cable 2. The cable 2 includes an earphone cable 21 and a connecting cable 22. The free end of the earphone cable 21 has an earphone (not shown), and the connecting cable 22 connects to electronic equipment 3. The electronic equipment 3 can be the common audio plug or the USB interface, as it is used in different situation. Wherein, the earphone cable 21 electrical connects to the connecting cable 22 by corresponding signal wire.

Figure 3:
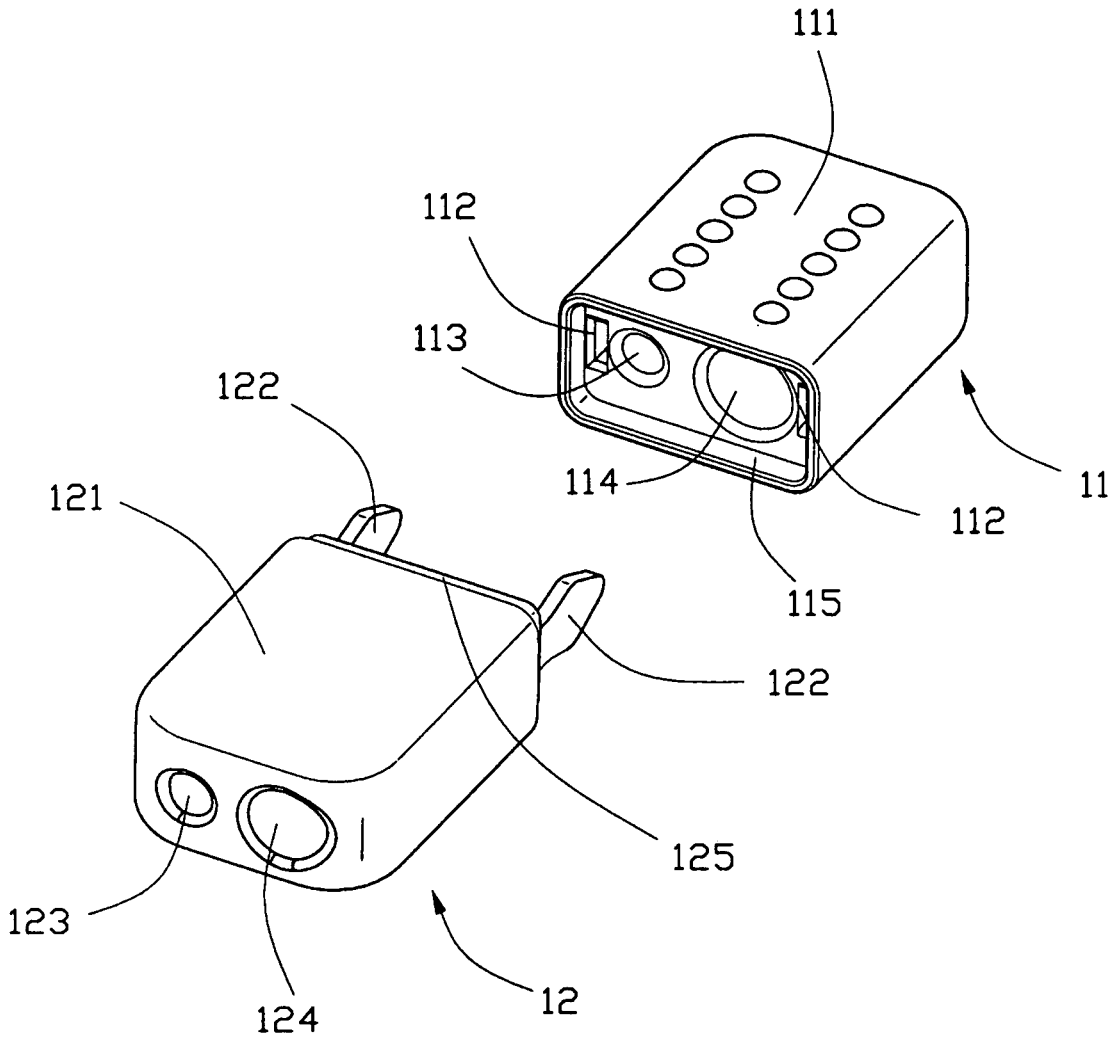
FIG. 3 is an exploded view of the adjusting member shown in FIG. 1.
Figure 4:
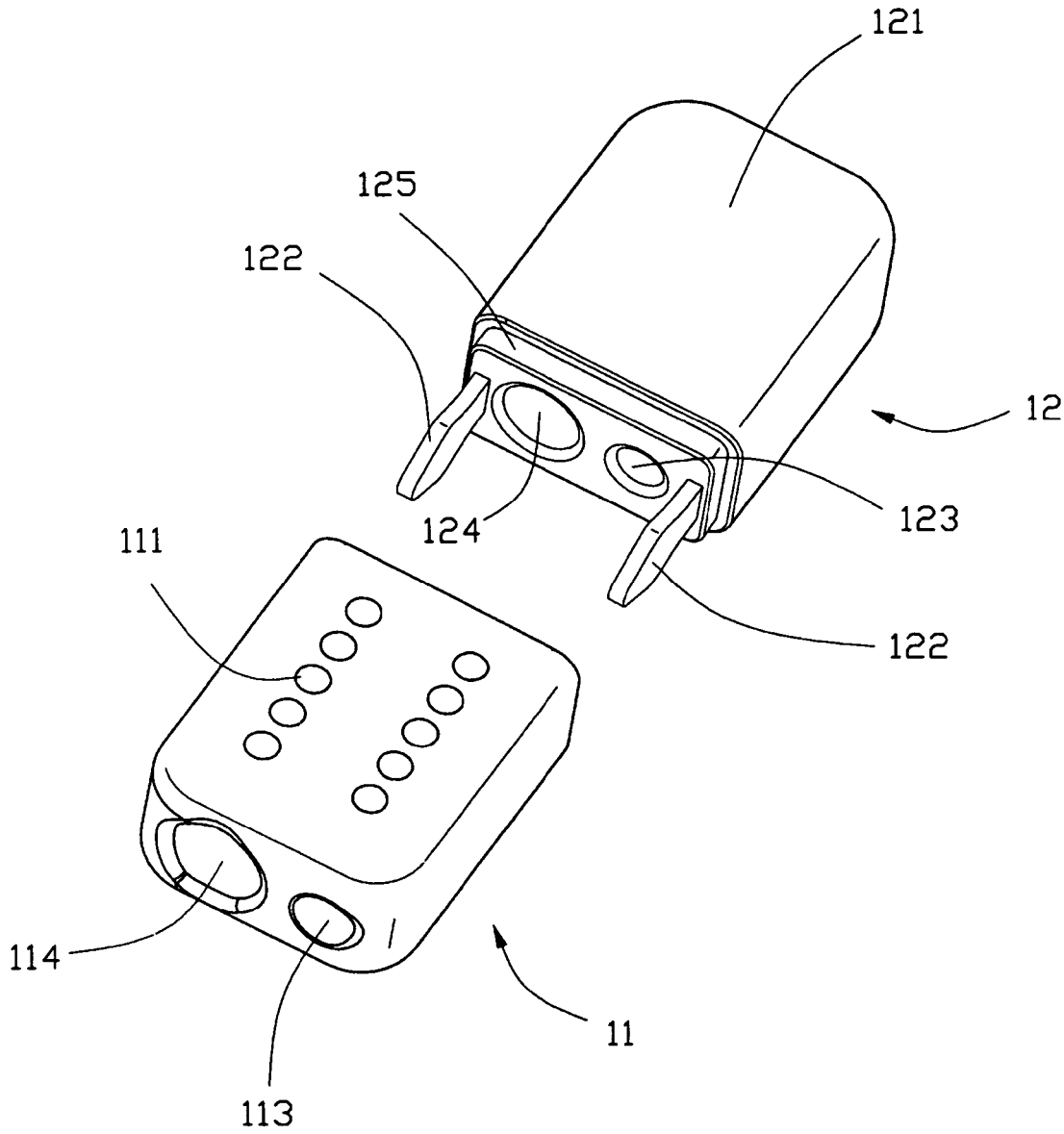
FIG. 4 is a view similar to FIG. 3, but viewed from another aspect.

As shown in FIGS. 3 and 4, the adjusting member 1 comprises a first half body 11 and a second half body 12. The first half body 11 includes a first grasping portion 111, a pair of channels 112, a first cavity 113 for receiving an earphone cable, a first passageway 114 for receiving a connecting cable and a first touching surface 115. The second half body 12 includes a second grasping portion 121, a pair of pins 122, a second cavity 123 for receiving an earphone cable, a second passageway 124 for receiving a connecting cable and a second touching surface 125.

Figure 5:
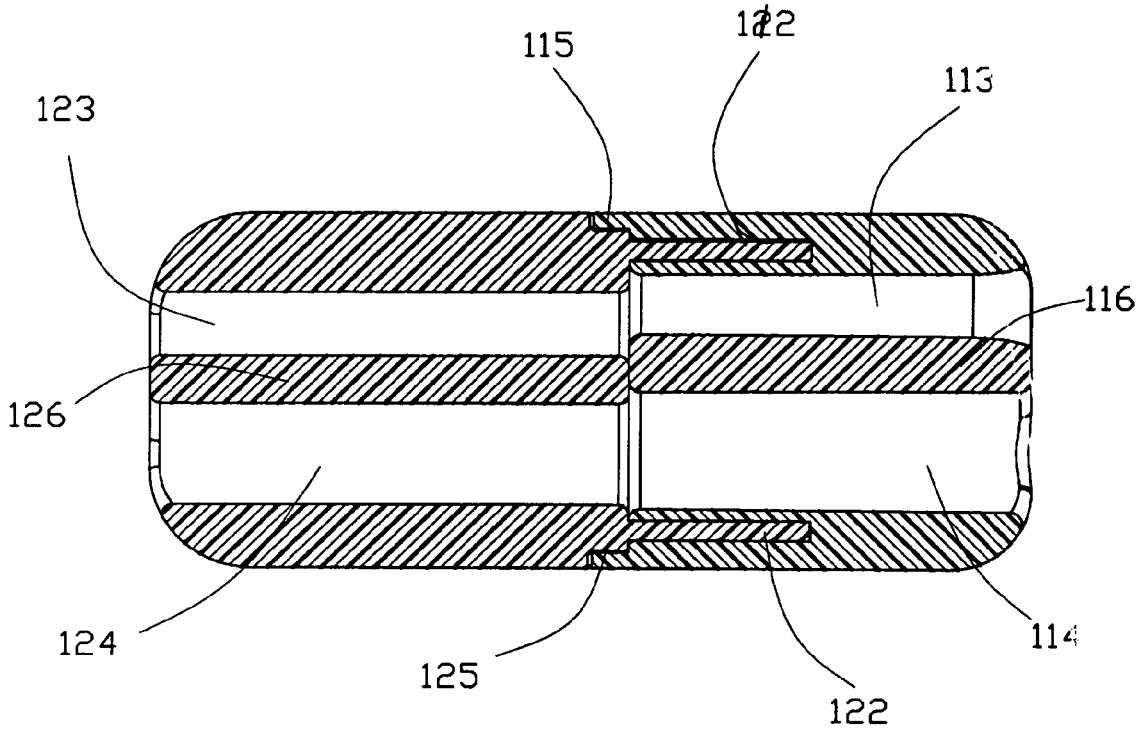
FIG. 5 is a cross-sectional view of FIG. 2 taken along line 5-5.

Referring to FIG. 3-5, as the first half body 11 assembling to the second half body 12, the pins 122 of the second half body 12 are inserted into the channels 112 of the first half body 11, and the first touching surface 115 overlaps with the second touching surface 125. The earphone cable 21 extends through the cavity (not labeled) consisted of the first cavity 113 and the second cavity 123, and the connecting cable 22 extends through the passageway consisted of the first passageway and the second passageway. The first cavity 113 and the second cavity 123 are eccentric after the first half body 11 and the second half body 12 are assembled, and so are the first rib 116 and the second rib 126. That means the first cavity 113 and the second cavity 123 having the axis located elsewhere than at the geometric center. The aperture of the cavity at the junction plane (not labeled) between the first cavity 113 and the second cavity 123 is smaller than the first cavity 113. So the earphone cable 21 will be engaged by the inner surface of the cavity at the junction plane, and then the adjusting member could fix on the cable 2. However, the junction plane will disappear after the first half body 11 and the second half body 12 are separated from each other. So, the adjusting member 1 could fix or slide on the cable 2 by assembling or separating the first half body 11 and the second half body 12, so as to adjust the length of the earphone cable 21 of the cable 2.

Figure 6:
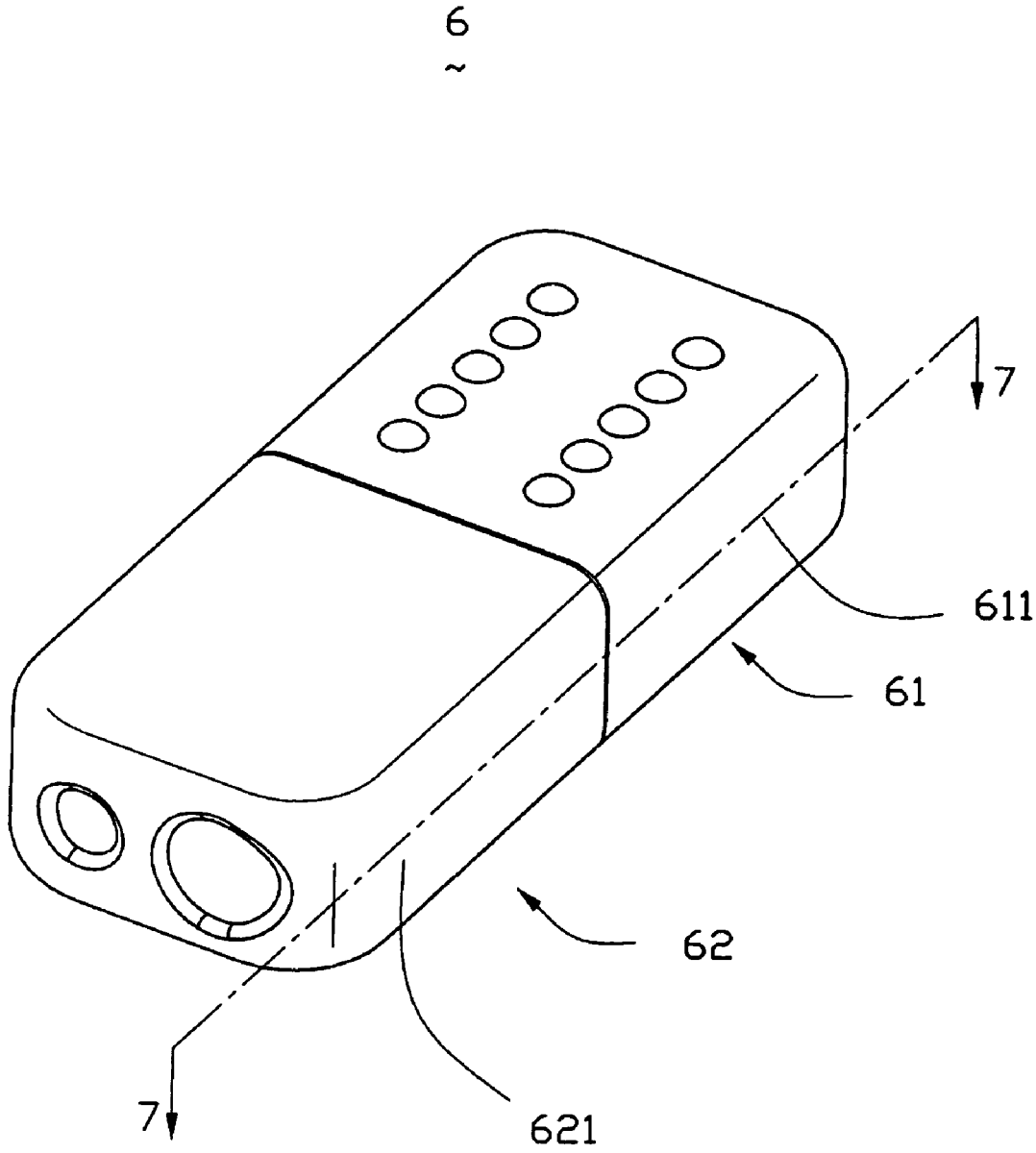
FIG. 6 is an assembled, perspective view of a second embodiment of the adjusting member.
Figure 7:
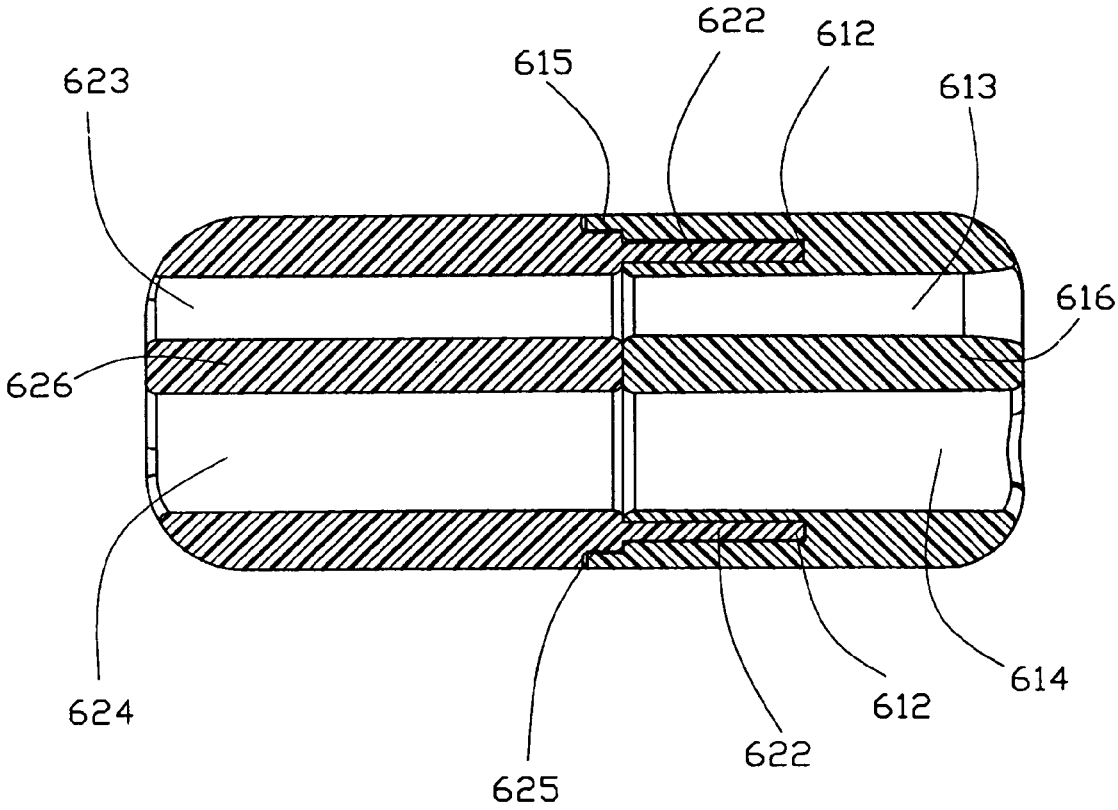
FIG. 7 is a cross-sectional view of FIG. 6 taken along line 7-7.

Referring to FIG. 6 and FIG. 7, it is the second embodiment of the adjusting member. The adjusting member 6 includes a first half body 61 and a second half body 62. The first half body 61 includes a first grasping portion 611, a pair of channels 612, a first cavity 613 for receiving an earphone cable, a first passageway 614 for receiving a connecting cable, a first touching surface 615 and a first rib 616. The second half body 62 includes a second grasping portion 621, a pair of pins 622, a second cavity 623 for receiving an earphone cable, a second passageway 624 for receiving a connecting cable, a second touching surface 625 and a second rib 626. The adjusting member 6 is similar to the said adjusting member 2 in structure, and the difference between said two is that the first cavity 613 and the second cavity 623 are not eccentric after the first half body 61 and the second half body 62 are assembled, and so are the first rib 116 and the second rib 126.

The first half body 61 is made of softer material than the second half body 62. The dimension of the pin 622 is bigger than the dimension of the channel 612. When the first half body 61 and the second half is assembling the bigger and harder pin 622 of the second half body will insert into the softer and smaller channel 612 of the first half body, then the channel 612 will be expended because of the pin 622. The aperture of the cavity and the passageway will be reduce because of the expended channel 612, and then the inner surfaces of the cavity and the passageway will engage with the earphone cable 21 and the connecting cable 22 received in the cavity and the passageway. However the aperture of the cavity and the passageway will restore after the first half body 61 and the second half body 62 are separated from each other. So, the adjusting member 6 also could fix and slide on the cable 2 by assembling and separating the first half body 61 and the second half body 62, so as to adjust the length of the earphone cable 21 of the cable 2.

The said two embodiment of adjusting member could adjust the cable, only included the earphone cable. In this case, it only needs one adjusting member. Two earphone cables will be received into the cavity, and then, the adjusting member may adjust the free end of the earphone from sliding on the cable up and down.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An adjusting member for a cable, comprises:

a first half body, defined a first closed cavity extending in a longitudinal direction with a first axis;

a second half body, defined a second closed cavity extending in said longitudinal direction with a second axis; and wherein the first and second half bodies are assembled together in said longitudinal direction, and the first and second closed cavities are connected in series for receiving a cable in a longitudinal direction, and the axes of the first and second cavities are out of alignment.

2. The adjusting member as described in claim 1, wherein the first half body defines a pair of channels and the second half body defines a pair of pins, the pins are inserted into the channels when the first half body is assembled to the second half body.

3. The adjusting member as described in claim 2, wherein the first half body made of soft material, and the second half body made of hard material.

4. The adjusting member as described in claim 3, wherein the dimension of the pin is larger than the channel, and the harder and larger pin insert into the softer and smaller channel when the first and second half body are assembled.

5. The adjusting member as described in claim 1, wherein the first half body defines a first touching surface, and the second half body defines a second touching surface, the first touching surface will overlap with the second touching surface.

6. The adjusting member as described in claim 1, wherein the cable includes earphone cable and connecting cable, and the integrative cavity includes an earphone cable cavity to receive the earphone cable and a connection cable passageway to receive the connection cable.

7. The adjusting member as described in claim 6, wherein the earphone cable earphone cable cavity is eccentric.

8. The adjusting member as described in claim 1, wherein the first half body and the second half body define an engagement surface when assembled between the first and second half bodies, and the diameter of the integrative cavity at the engagement surface is relatively smaller.

9. An adjusting member for a cable, comprises:

a first half body made of soft material, defining a first cavity for receiving the cable, and at least one channel; and a second half body made of hard material, defined a second cavity for receiving the cable and at least one pin;

wherein the first half body is assembled to the second half body, the first cavity and the second cavity form. a cavity to receive the cable, which extends through the adjust member, the dimension of the pin is larger than the channel, and the harder and larger pin insert into the softer and smaller channel when the first and second half body are assembled.

10. The adjusting member as described in claim 9, wherein the cable include earphone cable and connecting cable, and the cavity includes a cavity to receive the earphone cable and a passageway to receive the connection cable.

11. The adjusting member as described in claim 9, wherein the cable will engage with the inner surface of the cavity when the pin is inserted into the channel.

12. The adjusting member as described in claim 9, wherein the diameter of the cable is near to the aperture of the cavity.

13. A cable assembly, comprises:

a extending cable;

a first half body defines a first through hole receiving a first section of the cable; and a second half body defined a second through hole receiving a second section of the cable, the first section and the second section having a same diameter thereof; wherein when the first halt body is assembled to the second half body along an axial direction defined by both said first through hole and said second through hole, a periphery of the first through hale and that of the second through hole are offset from each other under a condition that one of the first half body and second half body is made from soft material while the other from hard material.

14. The assembly as claimed in claim 13, wherein an offset between said first through hole and said second through is derived from inherent eccentric arrangement between the first half body and the second half body.

15. The assembly as claimed in claim 13, wherein an offset between the first through hole and the second through hole is derived from an deformation of one of said first and second half bodies made of the soft material actuated by the other made of the hard material.

* * * * *